US008585875B2

(12) United States Patent
Cummings et al.

(10) Patent No.: US 8,585,875 B2
(45) Date of Patent: Nov. 19, 2013

(54) SUBSTRATE PLATING APPARATUS WITH MULTI-CHANNEL FIELD PROGRAMMABLE GATE ARRAY

(75) Inventors: Charles A. Cummings, Kalispell, MT (US); Mikael R. Borjesson, Lakeside, MT (US)

(73) Assignee: Applied Materials, Inc., Santa Clara, CA (US)

( * ) Notice: Subject to any disclaimer, the term of this patent is extended or adjusted under 35 U.S.C. 154(b) by 161 days.

(21) Appl. No.: 13/243,784

(22) Filed: Sep. 23, 2011

(65) Prior Publication Data

US 2013/0075264 A1 Mar. 28, 2013

(51) Int. Cl.

| | |
|---|---|
| ***C25B 9/04*** | (2006.01) |
| ***C25D 17/00*** | (2006.01) |
| ***C25D 21/12*** | (2006.01) |

(52) U.S. Cl.

USPC ..... 204/229.4; 205/81; 205/82; 205/83; 204/228.1; 204/228.6; 204/229.2; 204/229.3; 204/229.5

(58) Field of Classification Search

USPC ..... 205/81–83; 204/229.2–229.5, 228.6, 204/228.1

See application file for complete search history.

(56) References Cited

U.S. PATENT DOCUMENTS

| | | | | |
|---|---|---|---|---|
| 6,632,334 | B2 | 10/2003 | Anderson et al. | |
| 7,020,537 | B2 * | 3/2006 | Wilson et al. | 700/123 |
| 7,923,933 | B2 | 4/2011 | Serebryanov et al. | |
| 2006/0266653 | A1 * | 11/2006 | Birang et al. | 205/83 |
| 2007/0068819 | A1 * | 3/2007 | Singh et al. | 205/83 |
| 2010/0258444 | A1 * | 10/2010 | Weiner et al. | 205/137 |
| 2011/0024300 | A1 * | 2/2011 | Kruglick | 205/95 |

* cited by examiner

*Primary Examiner* — Nicholas A Smith
*Assistant Examiner* — Brian W Cohen
(74) *Attorney, Agent, or Firm* — Kenneth H. Ohriner; Perkins Coie LLP

(57) ABSTRACT

A system for electroplating a substrate includes one or more controllers, with each controller having an FPGA with one or more output channels. A bulk power supply is connected to each controller. One or more transistors are associated with each output channel. An electroplating chamber has one or more electrodes, with each electrode connected to at least one output channel. The system may include a waveform capture and viewing circuit providing built-in process verification and diagnostic tools. The system may also have a throttle back mode which attempts to maintain proper anode current ratios by reducing setpoints of all anodes by the same percentage, if a fault condition causes a reduction in current to one of the anodes. Blackbox logging may also optionally be used for recording selected data values into a circular buffer having a selected amount of memory.

5 Claims, 3 Drawing Sheets

SUBSTRATE PLATING APPARATUS WITH MULTI-CHANNEL FIELD PROGRAMMABLE GATE ARRAY

BACKGROUND OF THE INVENTION

The field of the invention is apparatus for electroplating substrates, such as silicon wafers and similar substrates. The field of the invention further relates to power supplies and controllers providing electrical power to electrodes in substrate electroplating apparatus.

In manufacturing micro-scale semiconductor and similar devices, process control equipment must meet requirements that are more demanding in comparison to most other industries. This results primarily because process parameters must be very closely controlled to successfully manufacture microelectronic devices. For example, in certain applications, it is important that a metal layer plated onto a substrate have uniform thickness over all areas of the substrate. Achieving a uniform plating profile or thickness requires precise control of electrical current provided via electrodes in the electroplating apparatus.

Electroplating apparatus in semiconductor manufacturing have used control systems similar to those used in other plating industries. Generally, these control systems include a combination of analog circuitry, and micro-controllers, or DSPs (digital signal processors), to read process parameters and close the feedback loop, allowing the system to produce the desired plating profile. These known control systems have met with varying degrees of success. Accordingly, there is a need for improved control systems and control methods.

BRIEF DESCRIPTION OF THE DRAWINGS

In the drawings, the same reference number indicates the same element in each of the views.

DETAILED DESCRIPTION

Figure 1:
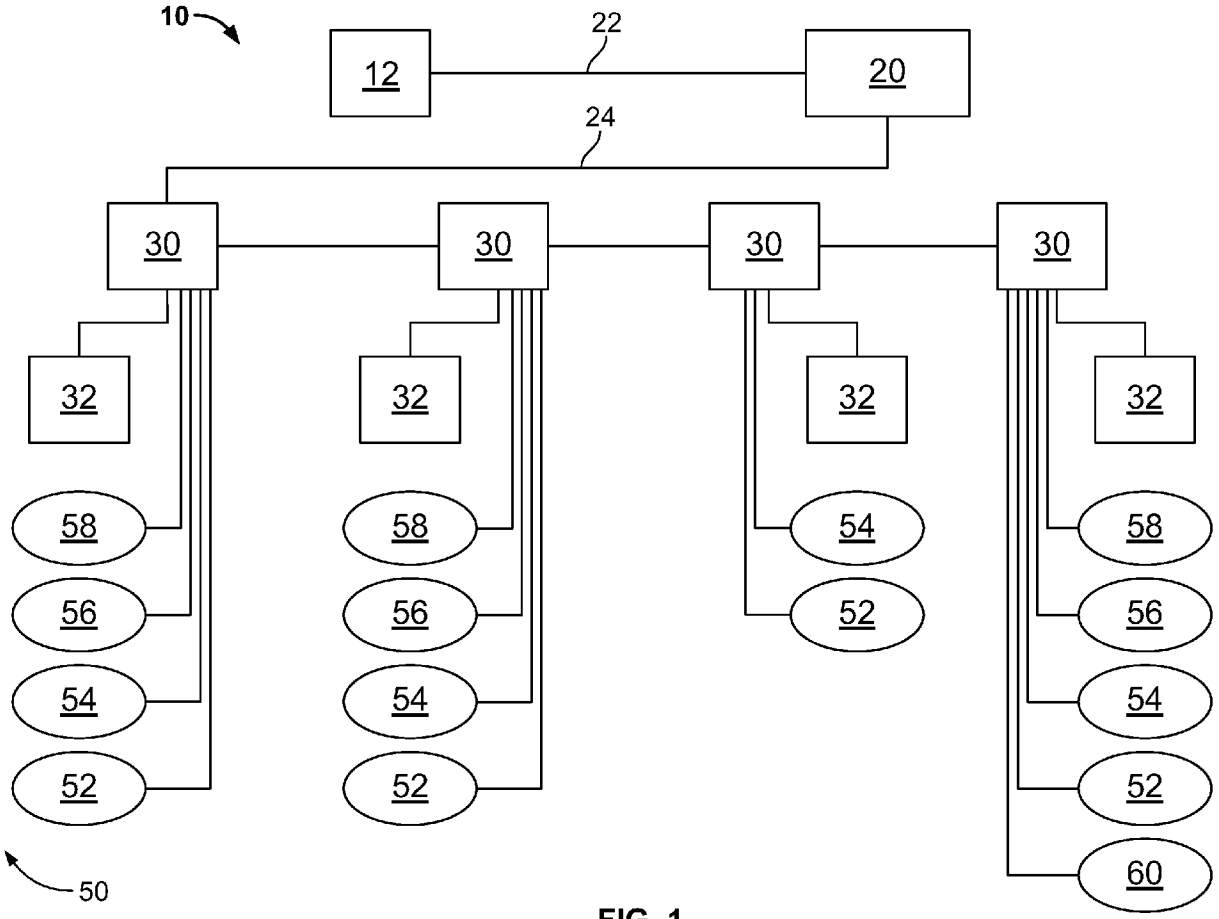
FIG. 1 is a diagram of an electrical control system of an electroplating apparatus.

As shown in FIG. 1, an electroplating apparatus 10 includes a computer 20 (for example a PC), connected to one or more controllers 30 via an IEEE 1394 Firewire connection 24, or a similar connection. Each controller 30 is connected to a bulk power supply 32, and to one or more electrodes 52 of an electroplating chamber. Alternatively, one or more controllers may share a common bulk power supply. The controller 30 provides precisely controlled current to the electrode(s) during electroplating processing.

Figure 2:
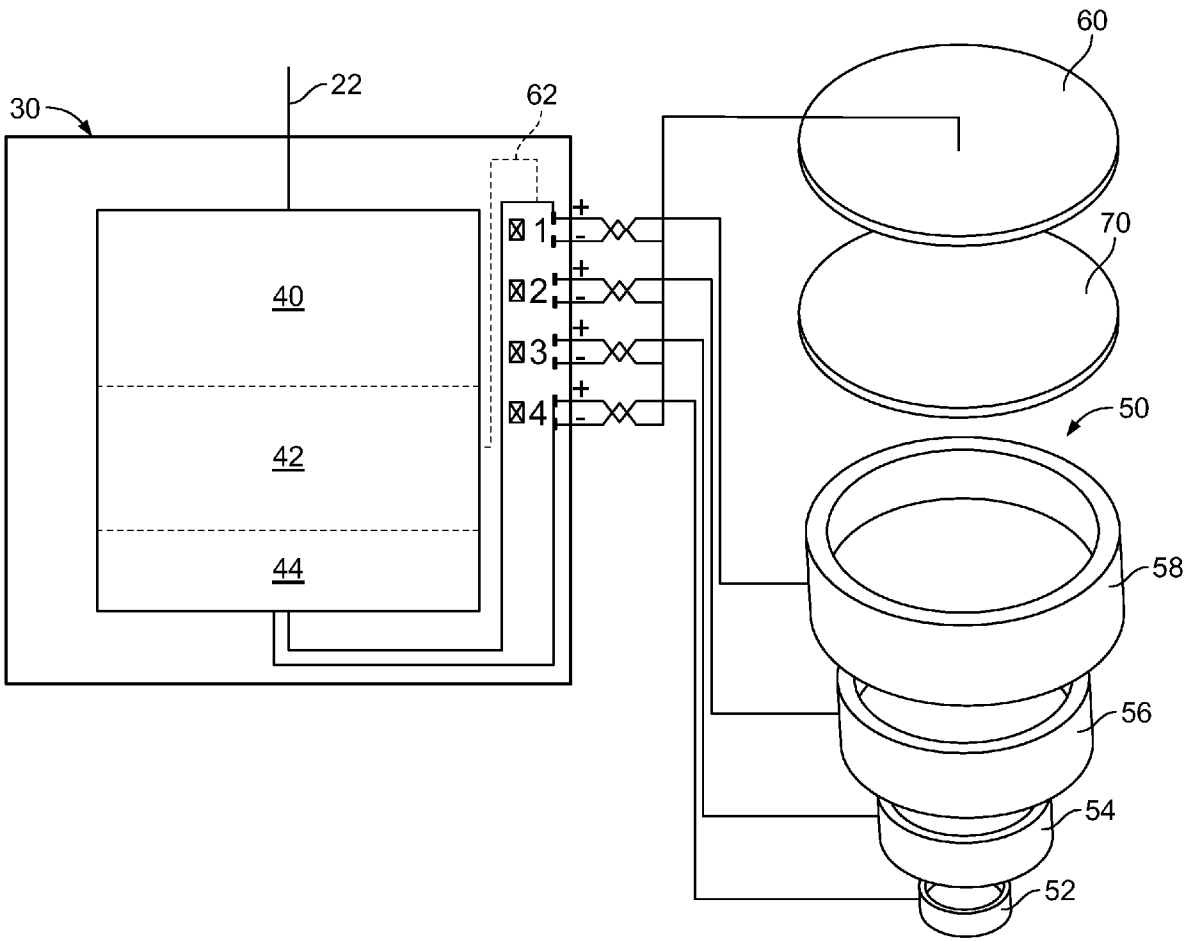
FIG. 2 is a diagram showing additional elements of the system shown in FIG. 1.

Referring to FIG. 2, the controller 30 includes a DSP section 40 connected with a field programmable gate array (FPGA) section 42. These may be provided in an embedded DSP/FPGA board. The controller 30 also includes a power transistor section 44 which is controlled by the FPGA 42. The power output from the transistors 44 is provided to one or more plating chambers 50. In the example shown in FIG. 2, the plating chamber 50 has a first anode 52, a second anode 54, a third anode 56, a fourth anode 58, and a cathode 60 which is electrically connected to the substrate. The controller 30 has four channels, with one channel controlling current to each anode.

As described for example in U.S. Pat. Nos. 7,390,383; US 2006-0237323 A1; U.S. Pat. No. 7,931,786; and U.S. Pat. No. 7,585,398, each incorporated herein by reference, electrolyte generally flows vertically up through the plating chamber 50, with metal ions depositing out onto a silicon wafer or other substrate 70, forming a metal layer on the substrate. Careful control of the current supplied to the anodes can help contribute towards making a highly uniform metal layer on the substrate, which is generally required for efficient manufacturing.

The FPGA 42 is used to implement the time sensitive control functions associated with electroplating metal layers onto substrates 70. For multi-channel designs, the parallel nature of the FPGA architecture provides dedicated resources for each channel simultaneously rather than sequentially as with other architectures. It is possible to optimize timing of control elements more easily with an FPGA than with a DSP or micro-controller, which results in higher system performance. Modern FPGA chips provide enough programmable logic to implement control loops for several plating channels within a single chip. This reduces system costs.

The system 10 may use a model based control system for achieving the desired output voltage or current. The power supply output transistors 44 can be modeled as being off until a minimum gate voltage is applied, with an approximately linear response above that threshold. The Offset parameter may apply a fixed output to bias the power supply's transistors 44 to their turn-on voltage. The slope parameter approximates the transistor response in the linear response area. It produces the drive that would be predicted to be required based on the set point and slope of the predicted response line.

FIG. 2 schematically shows a feedback loop with the measured output current to the anode(s) fed back into the FPGA 42 and compared to a target current. In the feedback control, the P-gain parameter can apply a drive proportional to the difference between the set point and actual response (error term), as is typical in a traditional PID control system. Rather than a single I (integral) term being used, a series of I terms may be maintained as a memory array for each control mode (voltage mode or current mode and range) and setpoint.

On the initial implementation, each mode's range of setpoints may be broken into 64 I term registers. Three parameters set the integral term's effect on the output. The I-gain parameter determines what portion of the present error to add into the integral accumulator. When the setpoint changes to a non-adjacent setpoint's I-term register, the I-term sample delay parameter inhibits update of the integral accumulator until the output has had time to settle to a stable value.

Although the system 10 may model the relationship between DAC counts applied to the transistors 44 and response in A to D counts as a linear relationship, it stores the I-term accumulator in DAC counts. The DAC-ADC ratio parameter is then used by the control system to convert an error expressed in AD counts into the estimated DAC change that is expected to correct the error. In operation, the I term parameters work together to compute the DAC output needed to hit the desired target. Although non-linearity of the system may cause the system to miss the setpoint on the first attempt, if system conditions change slowly, the system will "learn" the needed DAC setting. A second attempt to hit the same setpoint will be more accurate since the I-term accumulator value used from a previous attempt will give a more accurate drive value.

By handling functions using the FPGA 42 instead of using analog, the size and cost of the total system is reduced. Examples of functions handled by the FPGA 42 include: computation of error (set point vs. actual current or voltage output), and current and power limiting for output device protection. This eliminates manual adjustments, allows for automation of testing, and allows "hands off" optimization of system parameters that control performance such as waveform rise time and overshoot. The result is reduced labor cost. An additional benefit is the possibility of remote testing, system update, and update of optimization parameters.

The system 10 may include waveform capture and viewing, providing built-in process verification and diagnostic tools. This provides functionality equivalent to a multi-channel oscilloscope. Users can select process data (such as voltage, current outputs) to be stored each time a recipe or process is run. The user can select the desired sample rate and parameters to be stored (which will affect the data file size created). This data file provides a record of the process results which can be reviewed after the process run is finished. This speeds diagnosis of problems and allows verification of each process run.

The system 10 may also include a "throttle back" feature. Due to the high value of the substrates being plated, users put a high priority on successful completion of the plating process. When chambers use multiple anodes to control radial thickness of the plating on the substrate, it is necessary to assure the proper proportion of current from each anode is achieved. On existing equipment, fault conditions such current exceeding the maximum limit or transistor above temperature limit will trigger a protective response (such as transistor shut off or fuse opening) to protect against transistor destruction or fire hazard. Using the "throttle back' feature, if a fault condition happens on an anode that might cause a reduction in current in one of several anodes, the system attempts to maintain the proper anode current ratios by reducing the setpoints of all anodes by the same percentage.

For example, as anode material is deposited on the substrate and the distance from anode to substrate gets longer, a higher voltage and power must be supplied by the power supply. The higher voltage might increase the temperature on one of the transistors to a point where the power supply must reduce output power, to protect against transistor damage. This reduces the plating rate on that channel. If the system is programmed to use an amp-minute step termination, the system can still achieve the desired plated metal profile by plating at a reduced rate, but for require slightly longer time. The throttle back feature allows the power supply to finish plating the wafer while maintaining the desired current distribution. This increases the probability that the system will be able to produce the desired plating thickness profile on the substrate even if transient disturbances are present.

Since the control system is digital, more sophisticated control algorithms are achievable. The system may protect the transistors 44 from failure by computing the transistor die temperature based on measurements of current, voltage, and heat sink temperature. This results in more reliable transistor protection, and higher performance provided by the ability to operate the transistors 44 safely nearer their maximum thermal limit.

The system may use individual current read back sensors and DAC controls for each transistor of a multiple-transistor output channel This allows better performance and reliability because the system can assure that each transistor is working as expected and is being operated within its safe limits.

Figure 3:
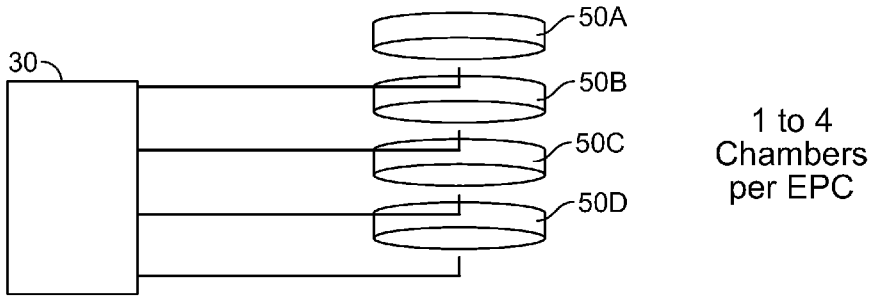
FIG. 3 is a diagram a first alternative design.
Figure 4:
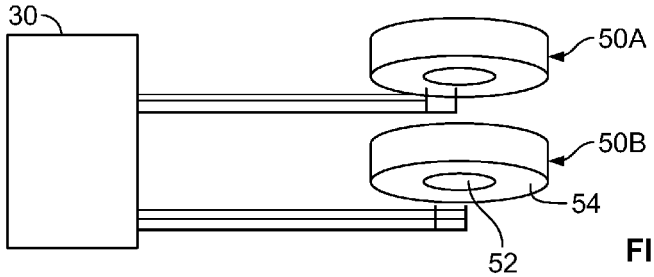
FIG. 4 is a diagram a second alternative design.
Figure 5:
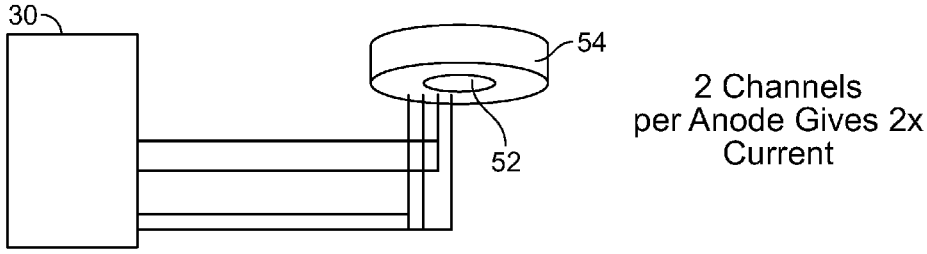
FIG. 5 is a diagram a third alternative design.
Figure 6:
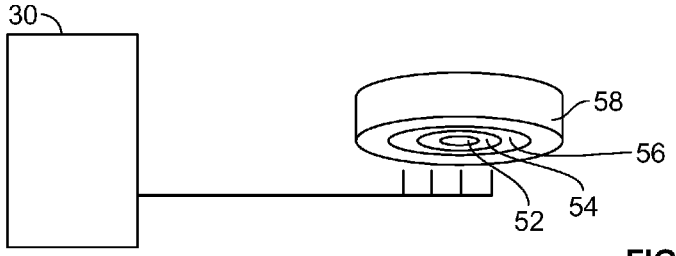
FIG. 6 is a diagram a fourth alternative design.

To allow maximum flexibility, each controller 30 may be designed to work with a programmable number of channels per chamber. For example, FIG. 3 shows a controller 30 having four output channels configured to work with a four 1-anode chambers. FIG. 4 shows a design with a controller 30 configured to operate two 2-anode chambers. FIG. 5 shows a controller 30 having four channels with a single 2-anode chamber. Here, two channels of the controller 30 are connected to each of the two anodes. This allows the controller 30 to provide twice as much current to each anode, in comparison to the single-channel-per-anode designs shown in FIGS. 3 and 4. FIG. 6 shows another alternative with each channel of a four-channel controller 30 connected to one of four anodes in a 4-anode chamber. Each controller 30 may have one or more output channels. The controllers 30 in FIGS. 3-6 are each shown having four output channels. However, the controllers 30 may have more or less than four channels. As shown in FIG. 1, a third controller 30 has two channels and a fourth controller has 5 channels.

The ability to group channels together and run multiple independent processes in one system may provide cost and size reduction in some cases. The configurability of the system may also reduce inventory and design costs by allowing the system 10 to be used for a wider variety of plating applications.

The system may use a computer subsystem to provide the interface between the controllers 30 and other process control equipment (which control fluid flow in the apparatus, substrate handling, status reporting, etc.). An IEEE 1394 interface may be used for communications between the computer 20 and the controller(s) 30. The computer 30 may communicate with other process control equipment using Ethernet 22. Since the FPGA 42 controls most of the time sensitive functions, a single computer 20 can provide the interface for several controllers 30. A single control computer 20 may support multiple controllers 30 each multiple channels. With one computer supporting several controllers 30, the system cost and size is reduced in comparison with a design that requires a support computer for each plating chamber.

The system may include a diagnostic feature known as Blackbox logging. This is similar in concept to the flight recorder used in airplanes. The technician can select from a number of different data types and choose a trigger type (greater than, less than, equal, or not equal) and a trigger value. The user also specifies how much memory should be allocated to data before the trigger point and after it.

By arming the trigger, the system starts recording data values into a circular buffer. After the triggering condition is sensed and remaining data recording is finished, the technician can review the data near the trigger point for diagnostic purposes, the FPGA may provide on-chip RAM for this function, By using a circular buffer, greater detail can be stored near the time of interest than would be possible with the "Waveform capture and viewing" feature described above. When operated in production mode, logging may be armed at the start of each process and triggered on any alarm or stop of the recipe, If the process stops unexpectedly, a technician can review data leading up to the alarm. This feature may reduce system downtime by speeding problem identification.

Although different components or sub-systems may be set up to handle different functions, in general, the system 10 may be designed with the FPGA 42 handling closing the feedback loop to make the channel output match process setpoint; computing channel current limit; computing transistor 44 power limit; "Throttling back" transistor gate drive to protect from damage; computing the difference between the setpoint and actual current; computing the integral term "I" and driving the transistors 44 to match the setpoint; and computing the proportional error "P" term to adjust the rise time and overshoot.

The system 10 may also be designed with the DSP 40 handling: setting the proper parameters (offset, slope, etc.) for each step's mode; adjusting the setpoint to the correct value throughout the plating process; (the setpoints should include calibration error adjustments); providing closed loop control throughout the plating process; updating the display for readback of voltage and current; and capturing data in memory to sending it via the 1394 link to the computer 20.

The computer 20 may handle: receiving the plating process parameters (current, waveform, timing, etc.) from a tool control computer 12 via Ethernet 22 and send it on to the DSP 40; receiving a start command from the tool control computer 12 via Ethernet 22 and sending it on to the DSP 40; sending readback status to the tool control computer 12 via Ethernet 22; updating the power supply status/ID displaying it via a connection, such as USB, at the computer 20; and saving a waveform file to a hard drive of the computer 20.

Thus, novel apparatus and methods have been shown and described. Various changes and substitutions may of course be made without departing from the spirit and scope of the invention. The invention, therefore, should not be limited, except by the following claims and their equivalents.

The invention claimed is:

1. A method of operation of a substrate electroplating system, comprising:

using a controller having an FPGA to independently control output current to two or more electrodes in an electroplating chamber, the FPGA having one or more output channels;

monitoring the output current supplied to each electrode and adjusting the output current to a desired setpoint in a feedback loop;

electroplating a substrate via current flow through an electrolyte from the electrodes to the substrate; with the output current to the electrodes provided by one of more transistors in each channel, and with the transistors mounted on a heat sink, further comprising: measuring current and voltage output of at least one transistor; measuring a temperature of the heat sink; calculating a die temperature of the at least one transistor based on the measurements of current, voltage and heat sink temperature; and reducing output of the transistor in the calculated die temperature exceeds a predetermined limit.

2. The method of claim 1 further comprising performing waveform capture.

3. The method of claim 1 further comprising:

sensing a fault condition which reduces current flow to an electrode; and throttling back the current provided to all electrodes to substantially maintain specified electrode current ratios, by reducing setpoints of all electrodes by the same percentage.

4. The method of claim 1 further comprising performing black box data logging by:

selecting a data type to be logged;

selecting a trigger type and trigger value;

arming the trigger; and recording the selected data type when a triggering condition is detected.

5. The method of claim 4 further comprising selecting an amount of memory to be allocated to recording the selected data before and/or after a triggering condition is detected, and recording the selected data into a circular buffer.

* * * * *